US006435047B1

(12) United States Patent
Kitagawa et al.

(10) Patent No.: US 6,435,047 B1
(45) Date of Patent: Aug. 20, 2002

(54) SHOE FOR SWASH-PLATE TYPE COMPRESSOR

(75) Inventors: Yoshiaki Kitagawa; Shogo Muramatsu; Masanori Akizuki; Hiroyuki Asano, all of Toyota (JP)

(73) Assignee: Taiho Kogyo Co., Ltd., Toyota (JP)

( * ) Notice: Subject to any disclaimer, the term of this patent is extended or adjusted under 35 U.S.C. 154(b) by 0 days.

(21) Appl. No.: 09/269,580

(22) PCT Filed: Aug. 4, 1998

(86) PCT No.: PCT/JP98/03454

§ 371 (c)(1),
(2), (4) Date: Mar. 26, 1999

(87) PCT Pub. No.: WO99/07998

PCT Pub. Date: Feb. 18, 1999

(30) Foreign Application Priority Data

Aug. 7, 1997 (JP) ..... 9-225712
Mar. 27, 1998 (JP) ..... 10-100594

(51) Int. Cl.[7] ..... B21D 53/10; F16H 23/00
(52) U.S. Cl. ..... 74/60; 427/202; 29/898.048
(58) Field of Search ..... 74/60; 428/641; 417/269; 427/202, 203; 29/898.048, 898.047, 898.12, 898.13, 888.02; 92/71

(56) References Cited

U.S. PATENT DOCUMENTS 4,138,775 A * 2/1979 Takaoka et al. ..... 26/156.4 R
4,263,814 A * 4/1981 Takaoka et al. ..... 74/60
4,285,640 A * 8/1981 Mukai ..... 417/269
4,357,201 A * 11/1982 Grabmaier et al. ..... 156/603
4,420,986 A * 12/1983 Nakayama et al. ..... 74/60
4,568,252 A * 2/1986 Hattori et al. ..... 417/269
4,683,804 A * 8/1987 Futamura et al. ..... 92/71
5,630,355 A * 5/1997 Ikeda et al. ..... 92/169.1
5,875,702 A * 3/1999 Kawagoe et al. ..... 92/12.2
5,943,941 A * 8/1999 Kato et al. ..... 92/12.2

FOREIGN PATENT DOCUMENTS

| | | |
|---|---|---|
| JP | 54-24304 | 2/1979 |
| JP | 54-95008 | 7/1979 |
| JP | 59-162377 | 9/1984 |
| JP | 60-184978 | 9/1985 |
| JP | 61-31682 | 2/1986 |
| JP | 3-217667 | 9/1991 |

* cited by examiner

*Primary Examiner*—David P. Bryant
*Assistant Examiner*—Marc W. Butler
(74) *Attorney, Agent, or Firm*—Flynn, Thiel, Boutell & Tanis, P.C.

(57) ABSTRACT

A method of manufacturing a shoe including cutting a columnar raw material to a given length to provide a disc-shaped raw material, forming on one end face of the disc-shaped raw material a spherical sliding surface which is to be disposed in sliding contact with a spherical surface on a piston, and forming a thermal sprayed layer on the other end face of the disc-shaped raw material. The thermal sprayed layer serves as a flat plate-shaped sliding surface which is to be disposed in sliding contact with a swash plate. A shoe which is provided with the thermal sprayed layer exhibits an increased seizure resistance in comparison to a conventional shoe which is formed with a sintered layer, and can be manufactured inexpensively.

7 Claims, 2 Drawing Sheets

SHOE FOR SWASH-PLATE TYPE COMPRESSOR

TECHNICAL FIELD

The present invention relates to a shoe and a method of manufacturing same, and more particularly, to a shoe which is used in a swash plate compressor and a method of manufacturing same.

BACKGROUND OF THE INVENTION

A method of manufacturing a shoe which is used in a swash plate compressor known heretofore is as follows:

Specifically, in a first manufacturing method, a columnar raw material of a given diameter is cut to a given length to provide a disc-shaped raw material, one end face of which is formed with a sintered layer, which is then formed into a sliding surface in the form of a flat plate that is to be disposed in sliding contact with a swash plate. Subsequently, the other end face of the disc-shaped raw material is formed with a spherical recess or a spherical sliding surface comprised of a spherical recess, that is to be disposed in sliding contact with a spherical surface on a piston.

Alternatively, in a second manufacturing method, a steel plate is previously formed with a sintered layer on one of its surfaces, and the plate-shaped raw material is punched into a columnar configuration to provide a columnar raw material. The surface which is provided with the sintered layer is formed into a sliding surface in the form of a flat plate that is to be disposed in sliding contact with a swash plate, while the other end face of the disc-shaped raw material is formed with a spherical recess or a spherical sliding surface comprised of a spherical recess that is to be disposed in sliding contact with a spherical surface on a piston.

The first manufacturing method has an advantage of good material yield because the columnar raw material is cut to a given length to provide the disc-shaped raw material, but has a disadvantage in respect of costs required because the work is complicated because of the need of providing the disc-shaped raw material and then forming the sintered layer thereon.

On the other hand, according to the second manufacturing method, because one surface of the steel plate is formed with the sintered layer, the step of forming the sintered layer is facilitated in comparison to the first manufacturing method, while the plate-shaped raw material which is formed with the sintered layer is punched into the columnar configuration to provide the columnar raw material, thus degrading the material yield to result in a disadvantage in respects of costs required.

In either manufacturing method, the use of the sintered layer resulted in a given limit being placed in improving the performance in respect of seizure resistance.

DISCLOSURE OF THE INVENTION

In view of the foregoing, the present invention provides a shoe and a method of manufacturing same which provide an excellent seizure resistance while allowing its manufacture in an inexpensive manner in comparison to the prior art.

Thus, the present invention relates to a shoe having a flat plate-shaped sliding surface which is adapted to be disposed in sliding contact with a swash plate and a spherical sliding surface which is adapted to be disposed in sliding contact with a spherical surface on a piston;

characterized in that a thermal sprayed layer is formed on the flat plate-shaped sliding surface of the shoe, the surface of the thermal sprayed layer serving as a flat plate-shaped sliding surface.

The present invention also provides a method of manufacturing a shoe which comprises a step of cutting a columnar raw material to a given length to provide a disc-shaped raw material, a step of forming on one end face of the disc-shaped raw material a spherical sliding surface which is adapted to be disposed in sliding contact with a spherical surface on a piston, and a step of forming a thermal sprayed layer on the other end face of the disc-shaped raw material by a H.V.O.F. (High Velocity Oxygen Fuel) spraying process, thus providing the thermal sprayed layer which serves as a flat plate-shaped sliding surface that is adapted to be disposed in sliding contact with a swash plate.

With the manufacturing method mentioned above, the columnar raw material is cut to a given length to provide the disc-shaped raw material, thus achieving a good material yield. In addition, the thermal sprayed layer is formed on the end face of the disc-shaped raw material. As compared with forming a sintered layer according to the prior art, the step of forming the thermal sprayed layer is facilitated, whereby the shoe can be manufactured inexpensively.

A shoe with the thermal flame sprayed layer exhibits a greater seizure resistance than a shoe with a sintered layer, and allows a more reliable operation of a swash plate compressor to be secured, in particular, under an underlubricated condition.

Where the H.V.O.F. spraying process is employed for the thermal spraying, a higher rate of thermal spraying produces a thermal sprayed layer which is more dense and which exhibits a greater strength of adhesion with the columnar raw material, whereby a highly excellent seizure resistance can be expected.

BEST MODE FOR CARRYING OUT THE INVENTION

Figure 1:
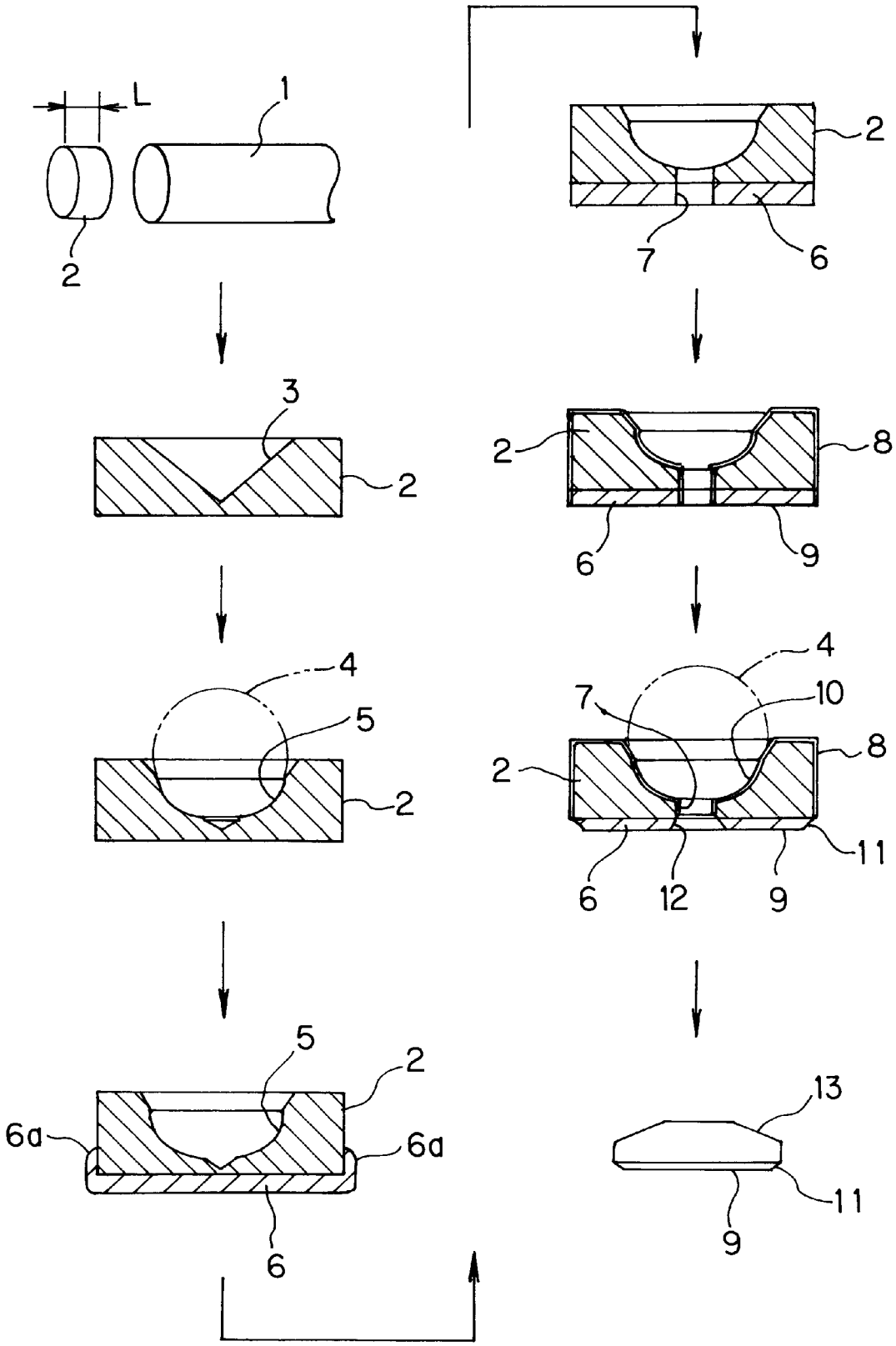
FIG. 1 illustrates a series of manufacturing steps showing one embodiment of the present invention.

A manufacturing method according to the present invention will be described below with reference to an embodiment shown. As shown in FIG. 1, a columnar raw material 1 having a diameter of 19 mm, which may comprise S45C, for example, is initially cut to a given length L to provide a disc-shaped raw material 2.

A conical opening 3 having an angle of 105° is then formed into one end face of the disc-shaped raw material 2, and a ball 4 having a diameter of 11 mm is pressed into the opening 3 to form a spherical recess 5 in an axially intermediate portion of the conical opening 3. The purpose of the spherical recess 5 is to allow a shoe to be ganged with a piston of a swash plate compressor through a ball, not shown.

A H.V.O.F. spraying process is then applied to the other end face of the disc-shaped raw material 2 or the end face thereof which is adapted to act as a sliding surface in the form of a flat plate that is to be disposed in sliding contact with a swash plate, not shown, thus forming a thermal sprayed layer 6 thereon to a thickness of 0.4 mm. During this process, the end face of the disc-shaped raw material 2 which is to be thermal sprayed is oriented upward for conducting the thermal spraying.

Upon removing a surplus portion 6*a* of the flame sprayed layer 6 which extends outside the outer peripheral surface of the disc-shaped raw material 2, a through-opening 7 which measures 3 mm in diameter is formed in alignment with the axis of the disc-shaped raw material 2, thus communicating the spherical recess 5 with the thermal sprayed layer 6 side through the through-opening 7. The through-opening 7 serves as an oil reservoir.

Additionally, a Cu plating layer 8 is then applied to a thickness of 20–30 $\mu$m to the entire area of the disc-shaped raw material 2 and the thermal sprayed layer 6, whereupon the surface of the thermal sprayed layer 6 inclusive of the plating layer 8 is removed to a thickness on the order of 0.1 mm, thus providing its surface which acts as a sliding surface 9 in the form of a flat plate that is to be disposed in sliding contact with the swash plate. The Cu plating layer 8 is formed in consideration of the sliding movement between the spherical recess 5 and a ball, not shown.

The ball 4 mentioned above is now again pressed into the spherical recess 5 to correct for any distortion caused by the thermal spraying operation, thus providing the surface of the spherical recess as a spherical sliding surface 10.

A chamfer 11 is then formed in a peripheral region from the thermal sprayed layer 6 to the columnar raw material 2, and a chamfer 12 is also formed around the inner peripheral surface of the through-opening 7 which is located toward the flat plate-shaped sliding surface 9.

The end face of the columnar raw material 2 which faces away from the flat plate-shaped sliding surface 9 or the end face having the spherical surface is shaved off through a reduced thickness so that the axial length of the columnar raw material 2 and the thermal sprayed layer 6 becomes equal to a given length.

Figure 2:
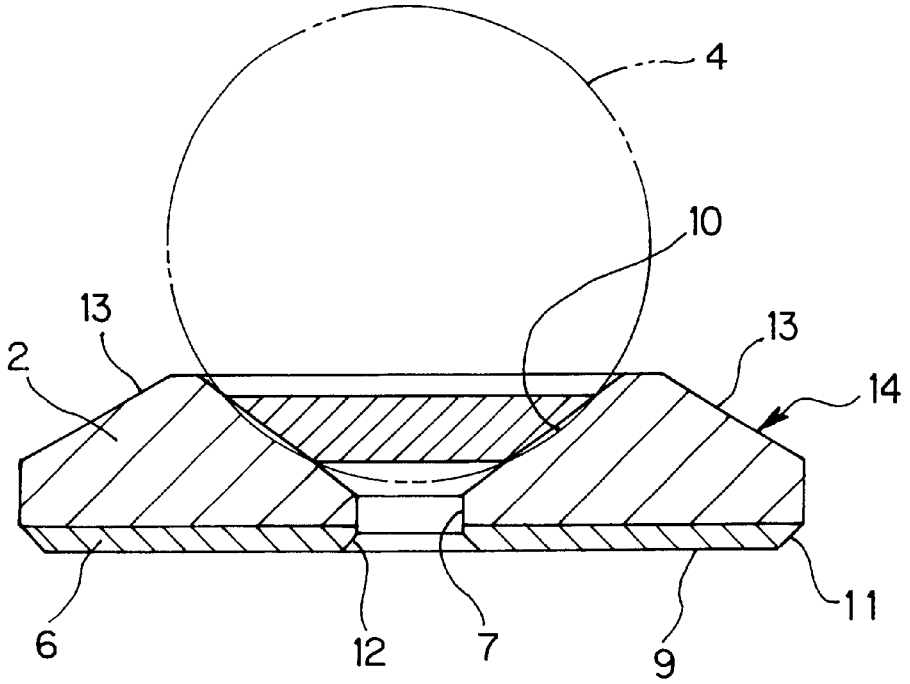
FIG. 2 is an enlarged cross section showing a completed shoe.

Subsequently, a large chamfer 13 having an angle of 30° is formed around the outer periphery of the end face of the columnar raw material 2 which has the spherical surface, and the flat plate-shaped sliding surface 9 is then subject to a lapping and a buffing sequentially to have a thickness of the flat plate-shaped sliding surface 9 which is in a range of 0.15–0.25 mm, thus providing a completed product of shoe 14 which is shown to an enlarged scale in FIG. 2.

When the rapid gas flame spraying process is applied to the flat plate-shaped sliding surface side of the shoe 14 to form the thermal sprayed layer 6 thereon in this manner so that the surface of the thermal sprayed layer 6 serves as the flat plate-shaped sliding surface 9, there can be obtained a shoe having a seizure resistance which is improved over the prior art.

Figure 3:
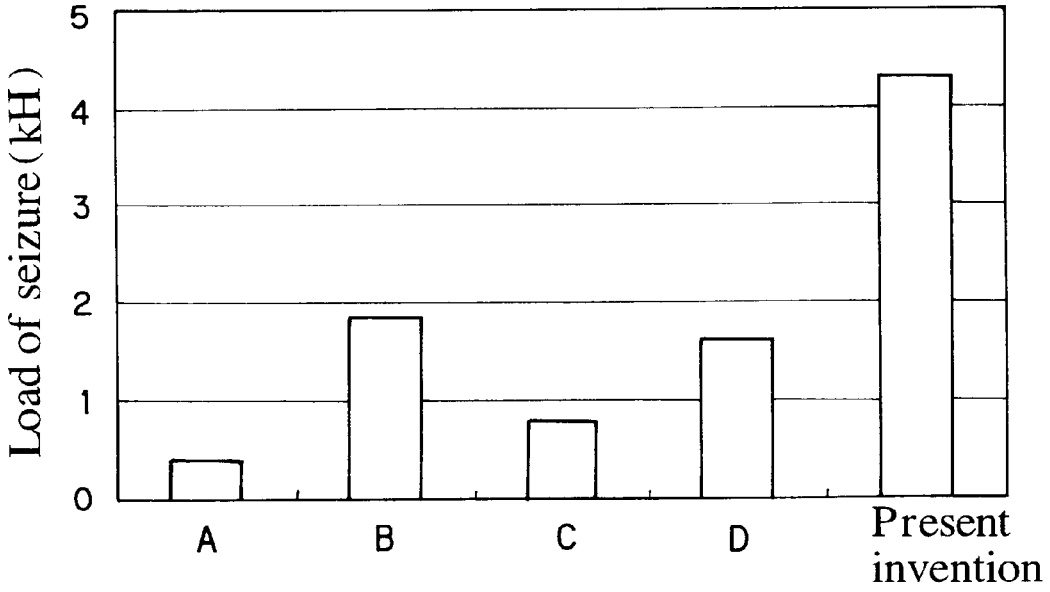
FIG. 3 is a diagram of test results illustrating the seizure resistance of the shoe according to the present invention.

FIG. 3 shows results of a test which determined the seizure resistance.

The test comprises rotating a disc formed by an FCD hardened material, bringing a shoe into abutment under pressure against the surface of the disc, and determining a load where a seizure occurs.

(Test Conditions)

Peripheral speed of shoe at point of contact: 15 m/s Load: 0.4 kN/10 min, gradually increasing Lubricant: ice machine oil.

The product according to the present invention has the flame sprayed layer 6 applied to the raw material S45C to a thickness of 0.15–0.25 mm by the rapid gas flame spraying process, and the flame sprayed layer 6 has components of remainder Cu-10 Sn-10Pb by weight percentage.

Control A is a shoe which is entirely formed of phosphor bronze (remainder Cu-6.5 Sn-0.2P).

Control B comprises S45C raw material on which a sintered layer is formed, the sintered layer having the same components as the product of the invention, namely, remainder Cu-10 Sn-10Pb.

Control C comprises a shoe which is entirely formed of T6 treatment of remainder Al-17 Si-4.5 Cu-0.5 Fe-0.5 Mg-0.1 Mn.

Control D comprises a shoe which is entirely formed of T6 treatment of remainder Al-17 Si-4 Cu-5 Fe-1.2 Mg-0.5 Mn.

As will be evident from test results shown in FIG. 3, the product of the present invention exhibits an excellent seizure resistance, and in particular, demonstrates its superior effect over the control B in which the same components as in the product of the present invention are sintered together.

Components to form the flame sprayed layer 6 according to the present invention may be a Cu alloy comprising at least one or two or more of added components consisting of 40% or less of Pb, 30% or less of Sn, 0.5% or less of P, 1.5% or less of Al, 10% or less of silver, 5% or less of Si, 5% or less of Mn, 5% or less of Cr, 20% or less of Ni and 30% or less of Zn, all represented by weight percentage, and a remainder of Cu.

By using a Cu alloy having such components, a more excellent seizure resistance performance can be obtained.

In particular, when using a Cu alloy, it is desirable that a thermal sprayed layer be formed from a mixture of undissolved texture and dissolved texture of atomized powders of the Cu alloy. Thus, atomized powders are generally dissolved as they are pumped into a flame by a gas, but part of the atomized powders can be left within the thermal sprayed layer by preventing the dissolution of part thereof during the thermal spraying operation as by expediting the cooling action. A more excellent seizure resistance performance can be obtained with a thermal sprayed layer which retains such texture.

To serve as the flame sprayed layer of the present invention, an Al alloy thermal sprayed layer comprising 12–60% by weight of Si and a remainder of Al substantially and in which particulate Si is dispersed in a matrix can be used. 0.1–30% of Sn may be contained in this flame sprayed layer and Sn particles may be dispersed in a matrix. In addition, at least one or more of added components consisting of 7% or less of Cu, 5% or less of Mg, 1.5% or less of Mn, 1.5% or less of Fe and 8% or less of Ni may also be contained.

An excellent seizure resistance performance can be obtained with an Al alloy having such components.

As compared with the strength of adhesion of 150–200 Kg/cm$^2$ which is obtained between a plasma sprayed layer and a raw material, such a strength of adhesion obtained with the H.V.O.F. spraying process is as high as 450–500 Kg/cm$^2$. It is generally admitted that the greater the strength of adhesion, the more the abrasion resistance is improved, and accordingly, it is desirable to employ the H.V.O.F spraying process when forming the thermal sprayed layer 6. However, any other spraying process may be used to form the thermal sprayed layer 6.

If any spraying process is used, the surplus portion 6*a* of the thermal sprayed layer 6 which projects outside the outer peripheral surface of the disc-shaped raw material 2 or any sprayed material which is sprayed on locations other than the disc-shaped raw material 2 can be recovered for reuse, which is an economical advantage.

In the described embodiment, the spherical sliding surface 10 which is concave is formed and is arranged to be ganged with a piston through a ball, but it should be understood that a convex spherical sliding contact surface may be formed for direct ganged motion with the piston, as is well known in the art.

In the described embodiment, the spherical recess 5 is formed before the thermal sprayed layer 6 is formed, but it is possible to reverse the sequence of these steps.

INDUSTRIAL AVAILABILITY

As discussed above, the present invention brings forth an effect that a shoe having an increased seizure resistance can be manufactured inexpensively in comparison to the formation of a sintered layer.

What is claimed is:

1. A shoe having a flat plate-shaped sliding surface disposed for sliding contact with a swash plate and a spherical sliding surface disposed for sliding contact with a spherical surface on a piston;

wherein a thermal sprayed layer is formed on the flat plate-shaped sliding surface of the shoe, the surface of the thermal sprayed layer acting as a flat plate-shaped sliding surface, and the thermal sprayed layer comprises 12–60% by weight of Si and a remainder substantially of Al, with particulate Si being dispersed in a matrix.

2. A shoe according to claim 1, wherein the thermal sprayed layer comprises 0.1–30% by weight of Sn, with Sn particles being dispersed in a matrix.

3. A shoe according to claim 2, wherein the thermal sprayed layer comprises at least one or more added components consisting of 7% or less of Cu, 5% or less of Mg, 1.5% or less of Mn, 1.5% or less of Fe and 8% or less of Ni, all represented by weight percentage.

4. A shoe for use in a swash plate-type compressor having a piston and a swash plate for causing reciprocating movement of the piston, said shoe comprising:

a first spherical surface disposed for sliding contact with the piston; and a second planar surface facing in an opposite direction from said first surface and disposed for sliding contact with the swash plate, said second surface including a thermally sprayed layer thereon comprising an Al alloy to minimize seizure of said piston and said shoe; said thermally sprayed layer comprising 12–60% by weight of Si and a remainder substantially of Al, with particulate Si being dispersed in a matrix.

5. The shoe of claim 4 wherein said first surface comprises a spherically concave recess for sliding contact with a spherically convex portion of the piston.

6. The shoe of claim 5 including an oil reservoir defined by a through-opening extending between said first and second surfaces, a first chamfered portion formed along an outer periphery of said second surface, and a second chamfered portion formed along an outer periphery of said first surface.

7. The shoe of claim 4 further comprising a base material of steel which defines said first and second surfaces thereon, and said thermally sprayed layer defining an outermost surface of said shoe for sliding contact with the swash plate.

* * * * *